United States Patent [19]

York et al.

[11] 4,310,925

[45] Jan. 19, 1982

[54] GARMENT

[75] Inventors: Alen S. York, New York, N.Y.; Judd M. York, Clover, S.C.

[73] Assignee: Countess York, Ltd., Kings Mountain, N.C.

[21] Appl. No.: 956,365

[22] Filed: Oct. 31, 1978

[51] Int. Cl.[3] ..... D05B 97/00; A41D 1/00

[52] U.S. Cl. ..... 2/69.5; 112/262.2

[58] Field of Search ..... 2/69, 69.5, 114; 5/334 C; D2/25; 2/88

[56] References Cited

U.S. PATENT DOCUMENTS

| | | | |
|---|---|---|---|
| 1,610,799 | 12/1926 | Lack et al. | 2/69 |
| 1,661,768 | 3/1928 | Marshall | 2/69 |
| 4,142,264 | 3/1979 | Whiting | 2/69.5 |

*Primary Examiner*—Doris L. Troutman

*Attorney, Agent, or Firm*—Diller, Ramik & Wight

[57] ABSTRACT

This disclosure relates to a garment of a tubular construction having a front and a back with the front being provided with a generally T-shaped slit defined by a leg normal and opening through an upper transverse edge of the front and an arm spaced from and parallel to the front upper edge, the cross-shaped slit defining at a juncture of its arm and leg first, second, third and fourth inboard corners, fifth and sixth inboard corners at the juncture of the leg and the free edge, and cooperative snap securing means for uniting selected ones of the inboard corners to each other and/or to other points on the front to provide the garment with a neck opening, arm openings and arm and shoulder portions.

18 Claims, 10 Drawing Figures

FIG.3
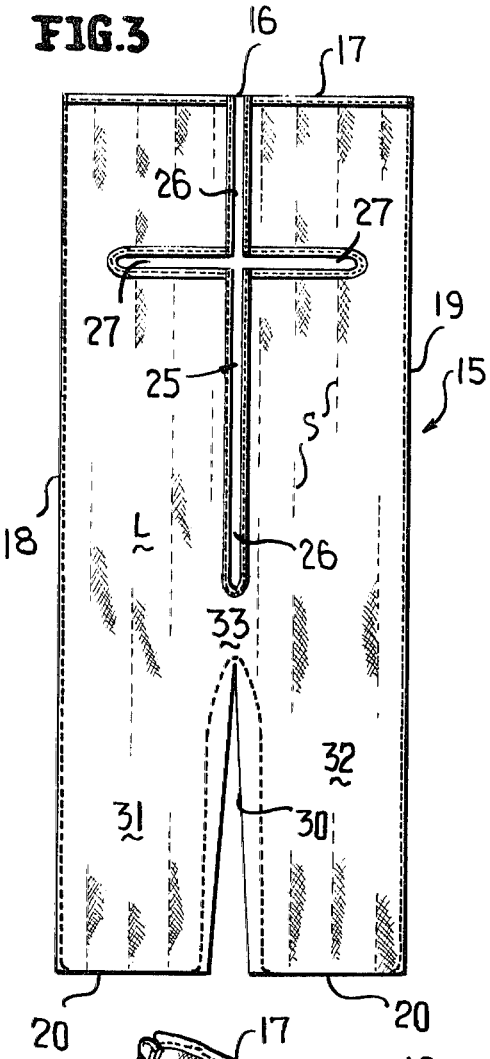
FIG.4
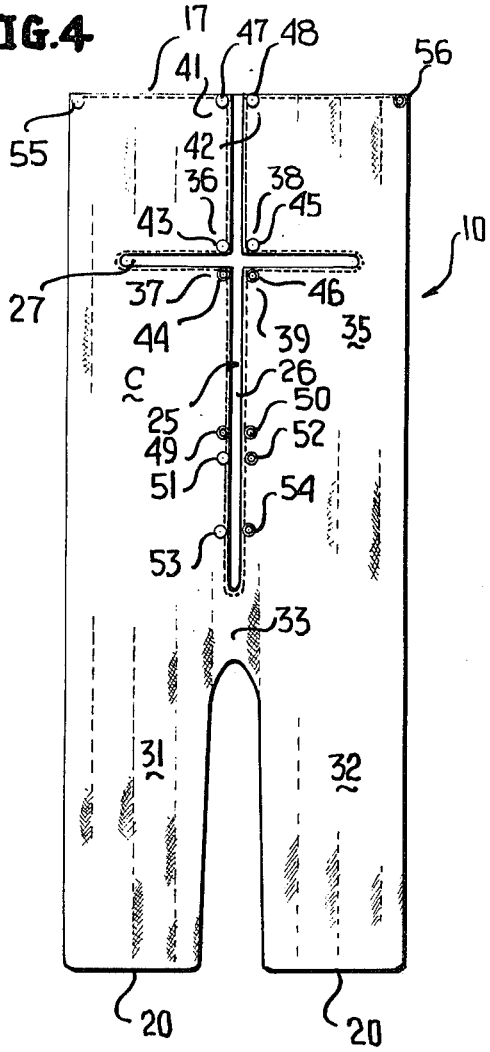
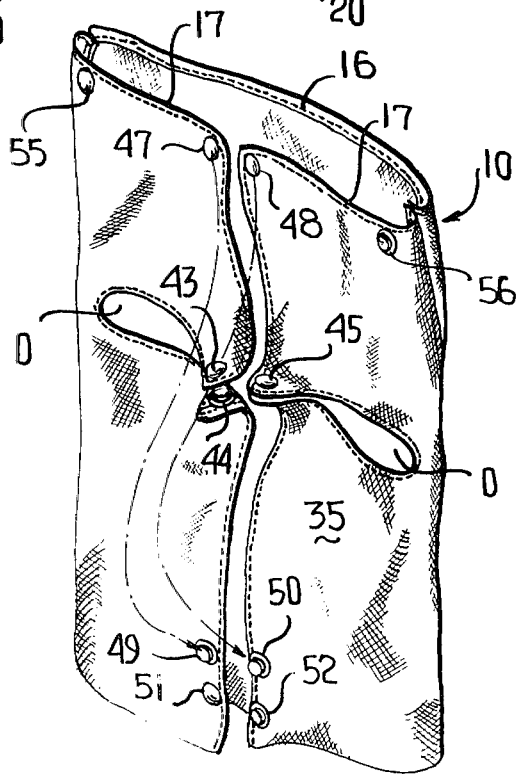
FIG.5

GARMENT

A primary object of this invention is to provide a novel garment which though made from comforter fabrics by utilizing traditional bedspread machinery is designed for casual wear whether standing, walking, sitting, etc., as well as being utilized as quilted pajamas. The garment thereby, for the first time, bridges the gap in the industry between a linen and domestic item and a ready-to-wear garment, and features contoured legs, a fly snap and arm sleeves which though similar to a conventional "jump suit" in appearance is uniquely distinguishable therefrom.

The novel garment of this invention includes a generally tubular body having a front and a back with the front cut by a cross-shaped slit defined by an arm and a leg with the leg being normal and opening through an uppermost free edge of the front, a juncture of the slit arm and leg defining first, second, third and fourth inboard corners, the leg and free edge of the front defining fifth and sixth corners, and means for securing the first and second and the third and fourth corners to each other, as well as the fifth and sixth corners to points remote from the second and fourth corners, respectively, to impart to the garment a neck opening, arm openings, and sleeve and shoulder portions.

Still another object of this invention is to provide a novel garment of the type described wherein the last-mentioned means are preferably, though not necessarily fasteners.

Still another object of this invention is to provide a novel garment of the type immediately heretofore set forth wherein the snap fasteners unite the first and second corners to each other with their inside surfaces in opposing relationship and similarly unite the third and fourth corners to each other.

Another object of this invention is to provide a novel garment of the type set forth herein wherein the fifth and sixth corners are united to the exterior of the garment front at points removed from the second and fourth corners, respectively, and on opposite sides of the leg of the slit.

Still another object of this invention is to provide a novel garment of the type set forth wherein the leg of the slit terminates adjacent a crotch and the tubular body is bifurcated by a pair of legs having closed bottoms.

Yet another object of this invention is to provide a novel garment wherein the covering or exterior material is cotton/polyester blended perma-press fabric, the lining material is brushed nylon tricot, and the filling material quilted in place is preferably 100 percent polyester fiber filled.

Still another of this invention is to provide a novel method of forming a garment of the type heretofore described wherein there is first provided a generally rectangular piece of quilted material having opposite generally parallel pairs of transverse and longitudinal edges, forming a cross-shaped slit in one-half of the material with the slit being defined by a longitudinal leg opening through one of the transverse edges and a horizontal arm, folding the material to align the transverse edges and sewing the longitudinal edges together to form an open top, closed bottom tube.

Still another object of this invention is to provide a novel method including the steps heretofore set forth wherein the cross-shaped slit and the one transverse edge define in part six inboard corners and providing fastening means at each of the six inboard corners for selectively securing the corners to each other and/or other points of the garment to provide a neck opening, arm openings, and arm and shoulder portions.

Still another object of this invention is to provide a novel method including the steps set forth herein and the further step of providing fastening means to either side of the leg of the slit remote from the arm and forming a pair of closed bottom legs from the tube bottom.

With the above and other objects in view that will hereinafter appear, the nature of the invention will be more clearly understood by reference to the following detailed description, the appended claims and the several views illustrated in the accompanying drawings.

In the drawings:

FIG. 1 is a top plan view of a generally rectangular blank or piece of material from which a garment is constructed in accordance with this invention, and illustrates a cross-shaped cut formed in the blank.

FIG. 1*a* is a fragmentary top plan view of the blank of FIG. 1 and illustrates the material along the top edge and the cross-shaped slit folded inwardly and hemmed.

FIG. 3 is a top plan view similar to FIG. 2 and illustrates stitching along longitudinal edges and inseams of the pair of legs.

FIG. 4 is a view similar to FIG. 3 but illustrates the garment of FIG. 3 turned inside out with snap fastening means secured at desired positions of the garment.

FIG. 5 is a fragmentary perspective view of the garment of FIG. 1 and illustrates the manner in which inboard corners at a junction of the cross-shaped slit are snapped secured to each other to form arm openings of the garment.

Figure 1:
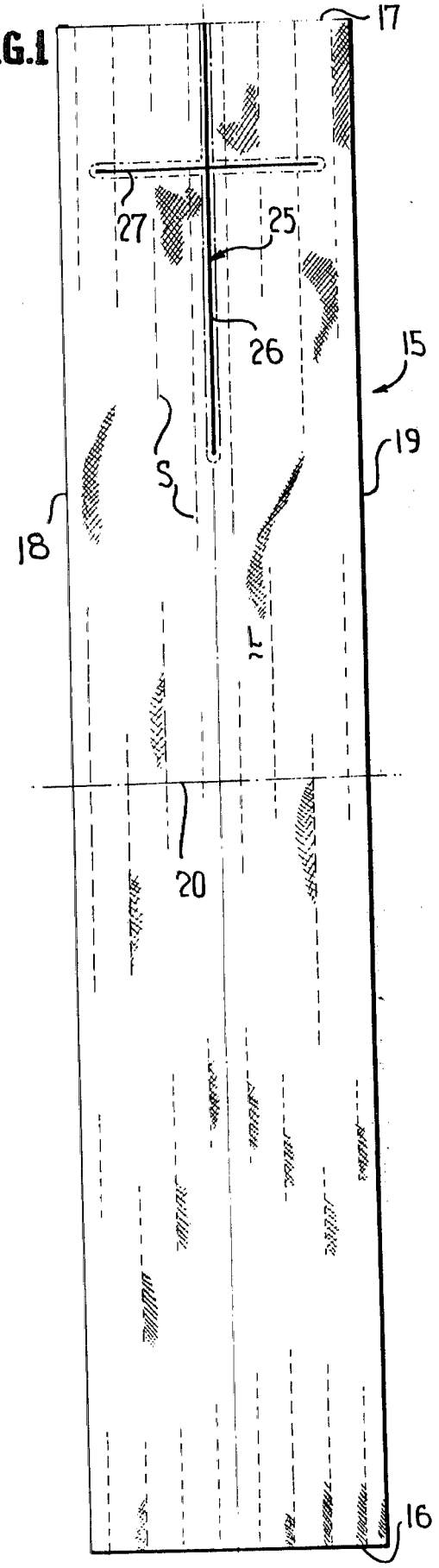

A novel garment constructed in accordance with this invention is best illustrated in FIGS. 4 through 9 of the drawings and is generally designated by the reference numeral 10. However, before describing the garment 10, reference is made to FIGS. 1 through 3 which illustrate a blank 15 manufactured in the manner to be described more specifically hereinafter.

Figure 2:
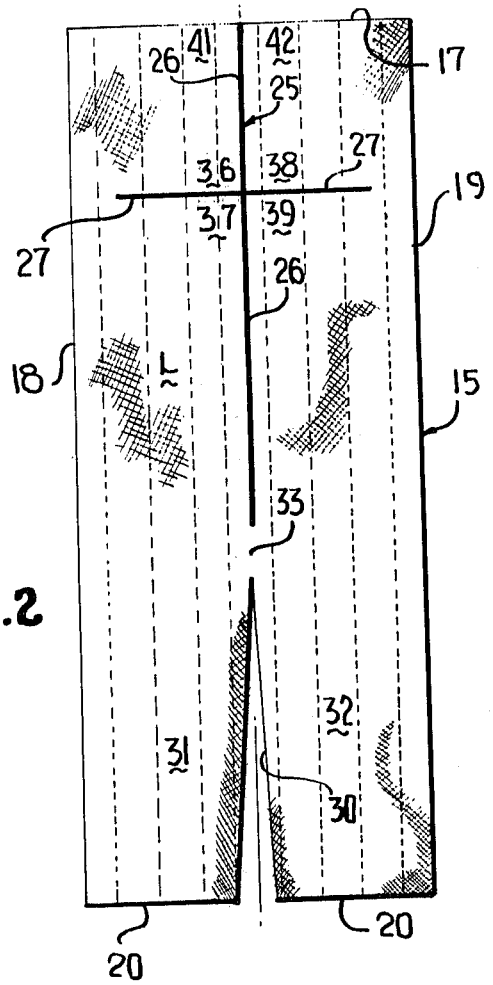
FIG. 2 is a top plan view similar to FIG. 1 with the hemming of FIG. 1*a* eliminated for simplicity and illustrates the manner in which the blank is folded along a transverse median fold line and cut to form a pair of legs.

The blank 15 is of a generally rectangular configuration and may be formed with one or more pieces of material including lining material L which eventually forms the inside of the garment, filling material (not shown) perferably 100 percent polyester fiber fill, and covering material C (FIG. 4) forming the exterior of the garment which is preferably cotton/polyester blend perma-press. The latter materials, while still in the rectangular configuration shown in FIG. 1, are appropriately sewn together in a quilt-like fashion by stitching S which though illustrated for simplicity as parallel lines of stitching can as well include transverse and/or oblique lines of stitching (not shown).

The blank 15 includes a lower transverse edge 16, an upper parallel transverse edge 17, a longitudinal side edge 18, and an opposite parallel longitudinal side edge 19. A transverse line of fold 20 is positioned midway between the transverse edges 16, 17. The eventual front of the garment 10 is formed by that portion of the material above the fold line 20 while the eventual rear or back of the garment is eventually formed by that portion of the material to the bottom of the fold line 20 (FIG. 1).

Figure 1A:
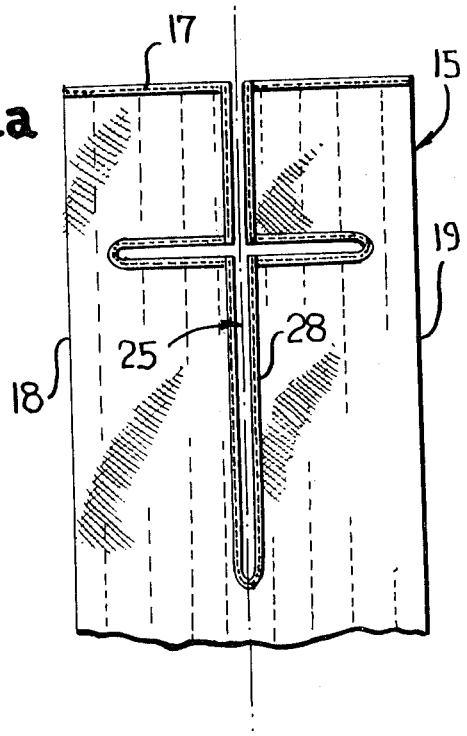
Figure 6:
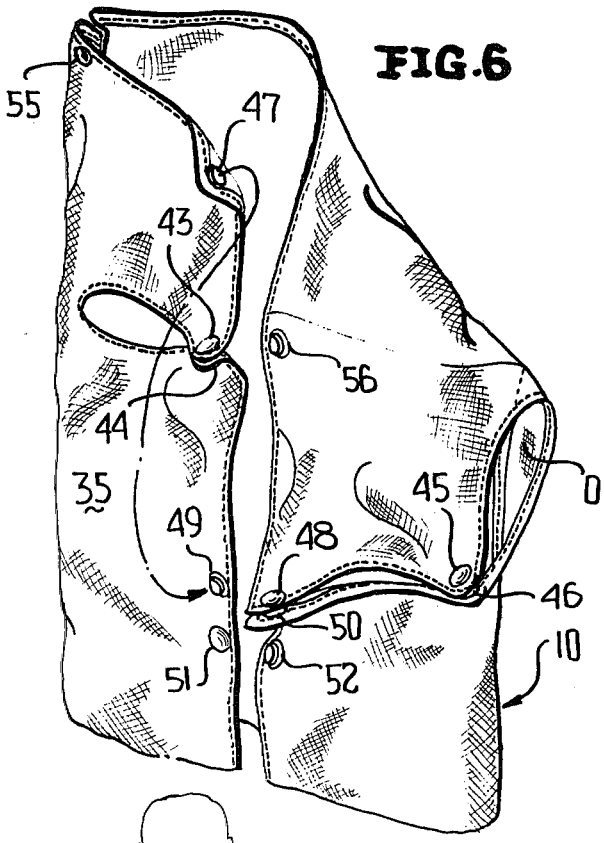
FIG. 6 is a perspective view of the garment similar to FIG. 5 and illustrates one of two uppermost inboard corners being snapped secured at a point located across the arm of the slit to form an arm and shoulder portion of the garment.
Figure 7:
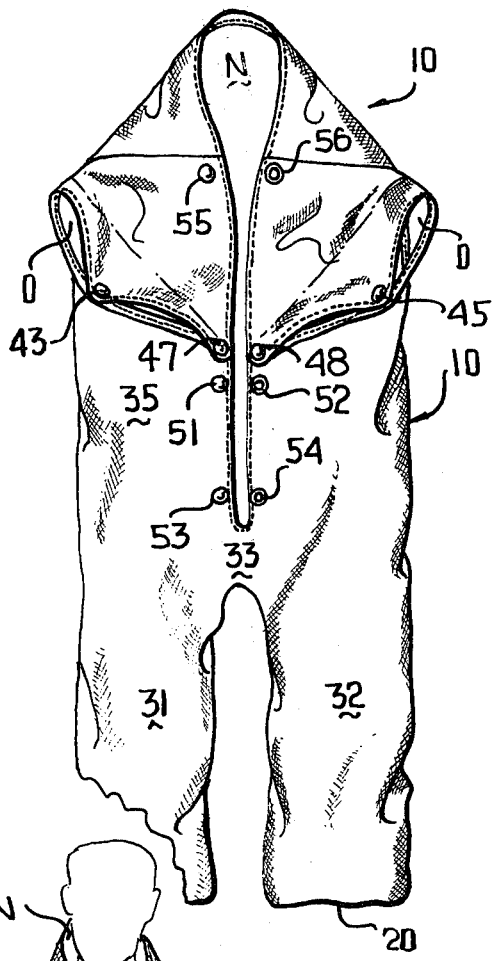
FIG. 7 is a front perspective view of the garment and illustrates the manner in which the selective snap fastening has formed a neck opening, arm openings, and shoulder and arm portions of the garment.
Figure 8:
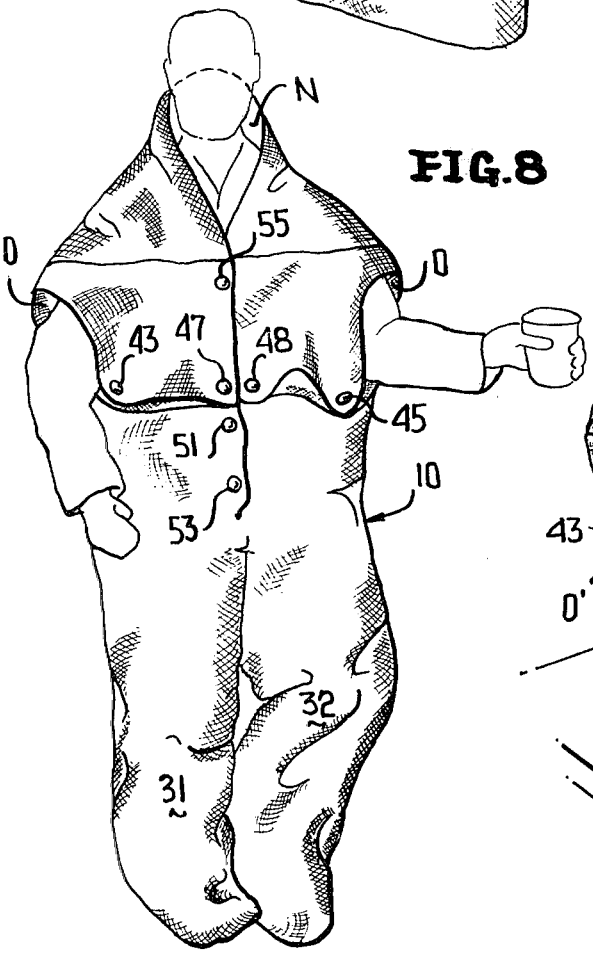
FIG. 8 is a perspective view of the garment and illustrates the manner in which the same is worn by a person.
Figure 9:
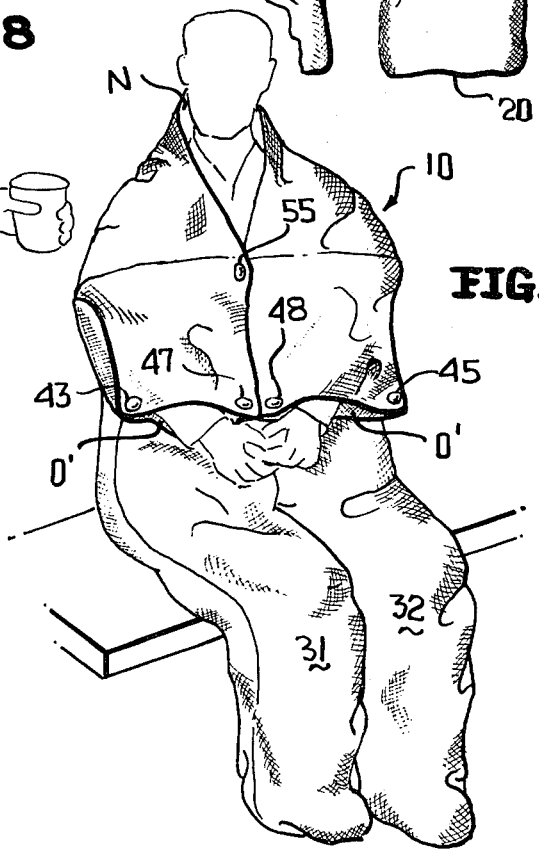
FIG. 9 is a perspective view similar to FIG. 8 and illustrates the garment when a person is in a sitting position.

A generally cross-shaped slit 25 is formed in the blank 15 above the fold line 20, and is defined by a leg 26 which is normal to and opens through the transverse edge 17 and a cross arm 27 parallel to the transverse edge 17 and terminating short of the side edges of longitudinal edges 18, 19. The dash/dot lines in FIG. 1 illustrate portions of the material bounding the cross-shaped slit 25 which are folded upon themselves and sewn in the manner shown in FIG. 1*a* to form a hem 28. The upper edge 17 is also folded, sewn and hemmed, again as shown in FIG. 1*a*, and the bottom edge 16 is also hemmed and sewn (not shown) to form a hem comparable to the hemmed edge 17 of FIG. 1*a*.

After the blank 15 has been hemmed, it is folded about the fold line 20 (FIG. 2) and a shallow inverted V-shaped slit 30 is formed therein which bifurcates a bottom portion (unnumbered) of the now folded blank 15 to eventually form upon a succeeding sewing operation a pair of legs 31, 32 having closed feet (unnumbered) which include the fold line 20 and a crotch 33.

The blank 15 is then sewn along the overlapped longitudinal edges 18, 19 in the manner illustrated in FIG. 3 and along the inseam inboard of the slit 30 to close the entire blank 15 except for the slit 25 and an opening formed by the aligned edges 16, 17. Thereafter a plurality of securing means in the form of cooperative male and female snap fasteners are secured to the blank 15 in a manner to be described more specifically hereinafter to complete the garment 10 which is simply turned inside out from that shown in FIG. 3 to bring the covering material C outermost and the lining material L innermost.

The cross-shaped slit 25 (FIG. 4) is disposed in a front 35 of the garment and at a juncture (unnumbered) thereof defines a first corner 36, a second corner 37, a third corner 38 and a fourth corner 39. The corners 36 through 39 are inboard relative to the longitudinal edges 18, 19, as are fifth and sixth corners 41, 42, respectively, adjacent the uppermost transverse edge 17. Securing means in the form of male and/or female snap fasteners are located at the corners 36 through 42 and are designated by the reference numerals 43 through 48, respectively. Additional fastening means 49, 50 are located on opposite sides of the leg 26 of the slit 25 below the respective fastening means 44, 46. Finally, cooperative fastening means, also in the form of snap fasteners, are designated at 51, 52; 53, 54 between the fastening means 49, 50 and the crotch 33; and fastening means 55, 56 at the uppermost left and right hand corners (unnumbered) of the front 35 as viewed in FIG. 4.

The fastening means 43, 45, 47, 48, 51, 53 and 55 are female fasteners in the sense that they have a recess into which is received the conventional projection (unnumbered) of the male fasteners 44, 46, 49, 50, 52, 54 and 56. All of the female fasteners 43, 45, 47, 48, 51, 53 and 55 open to the inside of the garment 10 while in the case of the projections of the male fasteners 44, 46, 49, 50, 52, 54 and 56, the projections of the male fasteners 44, 46 project to the inside of the garment 10 while the projections of the male fasteners 49, 50, 52, 54 and 56 project to outside of the garment 10. As is most readily apparent in FIGS. 5, 6 and 7, the various fastening or securing means are connected to each other in the following cuplets, namely, the female inside opening fastener 43 connected to the male inside projecting fastener 44; the female inside opening fastener 45 connected to the male inside projecting fastener 46; the female inside opening fastener 47 connected to the male outside projecting fastener 49; the female inside opening fastener 48 connected to the male outside projecting fastener 50; the female inside opening fastener 51 connected to the male outside projecting fastener 52; the female inside opening fastener 53 connected to the male outside projecting fastener 54 and the female inside opening fastener 55 connected to the male outside projecting fastener 56.

With the garment 10 and specifically the fasteners thereof secured together in the manner just described, a neck opening N (FIGS. 8 and 9) and arm openings or holes 0 are formed in the garment 10 along with appropriate areas (unnumbered) to accommodate a wearer's shoulders, arms, upper torso and back. The "normal" manner utilizing the garment 10 is in the fashion illustrated in FIG. 8 wherein the user's arms project through the openings 0, but in a sitting position (FIG. 9) auxiliary openings 0' may be utilized as hand openings.

Although only a preferred embodiment of the invention has been specifically illustrated and described herein, it is to be understood that minor variations may be made in the apparatus without departing from the spirit and scope of the invention, as defined in the appended claims.

We claim:

1. A garment comprising a generally tubular body having a front and a back, said front having an uppermost free edge, a generally cross-shaped slit disposed symmetrically relative to said front, said cross-shaped slit being defined by a leg disposed in generally transverse relationship to and opening through said uppermost free edge and an arm disposed generally transverse to said leg and in spaced relationship to said uppermost free edge, said cross-shaped slit defining first, second, third and fourth inboard corners of said front, said leg and uppermost free edge defining fifth and sixth inboard corner of said front disposed on the same side of said arm as said first and third corners, respectively, first means for securing said first and second corner to each other, second means for securing said third and fourth corner to each other, third means for securing said fifth corner to said front at a point remote from said second corner, and fourth means for securing said sixth corner to said front at a point remote from said fourth corner thereby forming a shoulder portion and arm openings in said body.

2. The garment as defined in claim 1 wherein at at least one of said first through fourth means are snap fasteners.

3. The garment as defined in claim 1 including fifth means adjacent said points for securing said top together across said leg.

4. The garment as defined in claim 1 wherein said leg terminates adjacent a crotch of said body.

5. The garment as defined in claim 1 wherein at least one of said first through fourth means are cooperative male and female snap fasteners.

6. The garment as defined in claim 1 wherein said first and second securing means secure said first and second corners and said third and fourth corner, respectively, inside-to-inside relationship to each other.

7. The garment as defined in claim 1 wherein said third and fourth securing means secure insides of said fifth and sixth corners, respectively, to the outside of said top at their respective points.

8. The garment as defined in claim 1 including fifth means adjacent said points for securing an inside of said front to an outside of said front across said leg.

9. The garment as defined in claim 6 wherein said third and fourth securing means secure insides of said fifth and sixth corners, respectively, to the outside of said top at their respective points.

10. The garment as defined in claim 6 including fifth means adjacent said points for securing an inside of said front to an outside of said front across said leg.

11. The garment as defined in claim 7 including fifth means adjacent said points for securing an inside of said front to an outside of said front across said leg.

12. A method of forming a garment comprising the steps of providing a generally rectangular piece of material having opposite generally parallel pairs of transverse and longitudinal edges, forming a cross-shaped slit in one-half of the material with the slit being defined by a longitudinal leg opening through one of the transverse edges and a horizontal arm, folding the material to align the transverse edges, and sewing the longitudinal edges together to form an open top, closed bottom tube.

13. The method as defined in claim 1 wherein the cross-shaped slit and the one transverse edge define in part six inboard corners, and providing a fastening means at each of the six inboard corners.

14. The method as defined in claim 13 including the step of providing fastening means to either side of the leg remote from the arm.

15. The method as defined in claim 14 including the step of forming a pair of closed bottom legs from the tube bottom.

16. A garment comprising a generally tubular body having a front and a back, said front having an uppermost free edge, a generally cross-shaped slit disposed symmetrically relative to said front, said cross-shaped slit being defined by a leg disposed in generally transverse reltaionship to and opening through said uppermost free edge and an arm disposed generally transverse to said leg and in spaced relationship to said uppermost free edge, said cross-shaped slit defining frist, second, third and fourth inboard corners of said front, and means for securing together at least said first and second corners and said third and fourth corners and said third and fourth corners to define with respective portions of said slit arm a pair of arm openings.

17. The garment as defined in claim 16 wherein said leg and uppermost free edge define fifth and sixth inboard corners, and means for securing said fifth and sixth inboard corners to said front at opposite sides of said slit leg and below said slit arm thereby defining a generally upwardly opening V-shaped neck area of said garment.

18. The garment as defined in claim 16 wherein said body has a closed bottom including therein a transverse fold line.

* * * * *